US010486016B2

(12) United States Patent
Robert et al.

(10) Patent No.: US 10,486,016 B2
(45) Date of Patent: Nov. 26, 2019

(54) INDOOR ROWER

(71) Applicants: Tilman Robert, Troisvierges (LU); TONIC FITNESS TECHNOLOGY, INC., Tainan (TW)

(72) Inventors: Tilman Robert, Troisvierges (LU); Mu-Chuan Wu, Tainan (TW)

(73) Assignees: Tilman Roberg, Troisvierges (LU); Tonic Fitness Technology, Inc., Tainan (TW)

( * ) Notice: Subject to any disclaimer, the term of this patent is extended or adjusted under 35 U.S.C. 154(b) by 169 days.

(21) Appl. No.: 15/860,860

(22) Filed: Jan. 3, 2018

(65) Prior Publication Data

US 2019/0201740 A1 Jul. 4, 2019

(51) Int. Cl.
*A63B 22/00* (2006.01)
*A63B 21/22* (2006.01)

(52) U.S. Cl.
CPC ..... *A63B 22/0076* (2013.01); *A63B 21/225* (2013.01); *A63B 2022/0079* (2013.01)

(58) Field of Classification Search
CPC ..... A63B 21/00058; A63B 21/00069; A63B 21/00076; A63B 21/00185; A63B 21/00192; A63B 21/005; A63B 21/0051; A63B 21/0052; A63B 21/0056; A63B 21/0057; A63B 21/012; A63B 21/0125; A63B 21/015; A63B 21/018; A63B 21/02; A63B 21/023; A63B 21/025; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/08; A63B 21/15; A63B 21/151; A63B 21/152; A63B 21/153; A63B 21/154; A63B 21/22; A63B 21/225; A63B 21/4027; A63B 21/4031; A63B 21/4033; A63B 21/4034; A63B 21/4035; A63B 21/4041; A63B 21/4045; A63B 21/4047; A63B 21/4049; A63B 22/0046; A63B 22/0076;

(Continued)

(56) References Cited

U.S. PATENT DOCUMENTS 1,916,883 A * 7/1933 De Vere ..... A63B 22/0076 482/72
1,974,445 A * 9/1934 Calleson ..... A63B 22/0076 482/72

(Continued)

*Primary Examiner* — Gary D Urbiel Goldner
(74) *Attorney, Agent, or Firm* — C. G. Mersereau; DeWitt LLP

(57) ABSTRACT

An indoor rower has a frame, a rolling assembly, and a winding assembly. The frame has a beam having a first end and a second end. The rolling assembly is disposed adjacent to the second end of the beam and has a rotatable wheel hub and a cable coiled around the wheel hub. The cable has a first cable end fastened to the wheel hub and a second cable end connected to a handle. The winding assembly has a first pulley set disposed adjacent to the first end of the beam, a second pulley set disposed at the second end of the beam, and an elastic cord coiled around the wheel hub, the first pulley set, and the second pulley set. The elastic cord has a first cord end being stationary and a second cord end being fastened to the wheel hub.

12 Claims, 9 Drawing Sheets

(58) Field of Classification Search
CPC ..... A63B 22/20; A63B 22/201; A63B 22/203; A63B 2022/0079; A63B 69/06; A63B 2069/062; A63B 71/0054; A63B 2071/0063; A63B 2071/0072
See application file for complete search history.

(56) References Cited

U.S. PATENT DOCUMENTS

| | | | | | |
|---|---|---|---|---|---|
| 4,798,378 | A * | 1/1989 | Jones | A63B 21/0052 | 482/72 |
| 4,846,460 | A * | 7/1989 | Duke | A63B 21/153 | 482/73 |
| 4,884,800 | A * | 12/1989 | Duke | A63B 21/154 | 482/73 |
| 5,072,929 | A * | 12/1991 | Peterson | A63B 22/0076 | 310/105 |
| 6,162,152 | A * | 12/2000 | Kuo | A63B 21/0051 | 482/57 |
| 7,862,489 | B2 * | 1/2011 | Savsek | A63B 21/0455 | 482/121 |
| 2002/0016237 | A1 * | 2/2002 | Schmidt | A63B 21/0058 | 482/70 |
| 2004/0077465 | A1 * | 4/2004 | Schmidt | A63B 21/0058 | 482/57 |
| 2007/0082793 | A1 * | 4/2007 | Yang | A63B 21/00069 | 482/72 |
| 2010/0144496 | A1 * | 6/2010 | Schmidt | A63B 21/012 | 482/70 |
| 2019/0054343 | A1 * | 2/2019 | Chiang | A63B 22/0076 | |

* cited by examiner

INDOOR ROWER

BACKGROUND OF THE INVENTION

1. Field of the Invention

The present invention relates to resistance training equipment, and more particularly to an indoor rower that takes a restoring force of an elastic cord as resistance.

2. Description of Related Art

With increasing awareness in exercising and health care, an indoor rower is provided for people having a busy, fast-paced lifestyle to simulate the action of rowing a watercraft indoors.

A conventional indoor rower has a frame, a resistance assembly, a cable, a handle, a seat, and two stepping mounts. The frame has two opposite ends. The resistance assembly is disposed at one of the two opposite ends of the frame. The cable is wound in the resistance assembly. The handle is connected to an end of the cable and is disposed outside the resistance assembly. The seat is movably mounted to the frame. The two stepping mounts are respectively mounted to two sides of the frame. A user sits on the seat, steps on the two stepping mounts, and pulls the handle to simulate the action of watercraft rowing to work out. Simulating the action of watercraft rowing can promote cardiopulmonary function and circulation of the user.

The resistance assembly of the conventional indoor rower provides resistances in multiple manners such as magnetic resistance, air resistance, water resistance, or hydraulic oil resistance. The structure of the resistance assembly is complicated, and the resistance assembly is difficult to be assembled and costs high manufacturing expense.

To overcome the shortcomings of the resistance assembly of the conventional indoor rower, the present invention provides an indoor rower to mitigate or obviate the aforementioned problems.

SUMMARY OF THE INVENTION

The main objective of the present invention is to provide an indoor rawer that takes a restoring force as resistance and has a simple structure.

The indoor rower comprises a frame, a rolling assembly, and a winding assembly. The frame has a beam having a first end and a second end. The rolling assembly is disposed adjacent to the second end of the beam and has a rotatable wheel hub and a cable coiled around the wheel hub. The cable has a first cable end fastened to the wheel hub and a second cable end connected to a handle. The winding assembly has a first pulley set disposed adjacent to the first end of the beam, a second pulley set disposed at the second end of the beam, and an elastic cord coiled around the wheel hub, the first pulley set, and the second pulley set. The elastic cord has a first cord end being stationary and a second cord end being fastened to the wheel hub.

Other objects, advantages, and novel features of the invention will become more apparent from the following detailed description when taken in conjunction with the accompanying drawings.

DETAILED DESCRIPTION OF PREFERRED EMBODIMENTS

Figure 1:
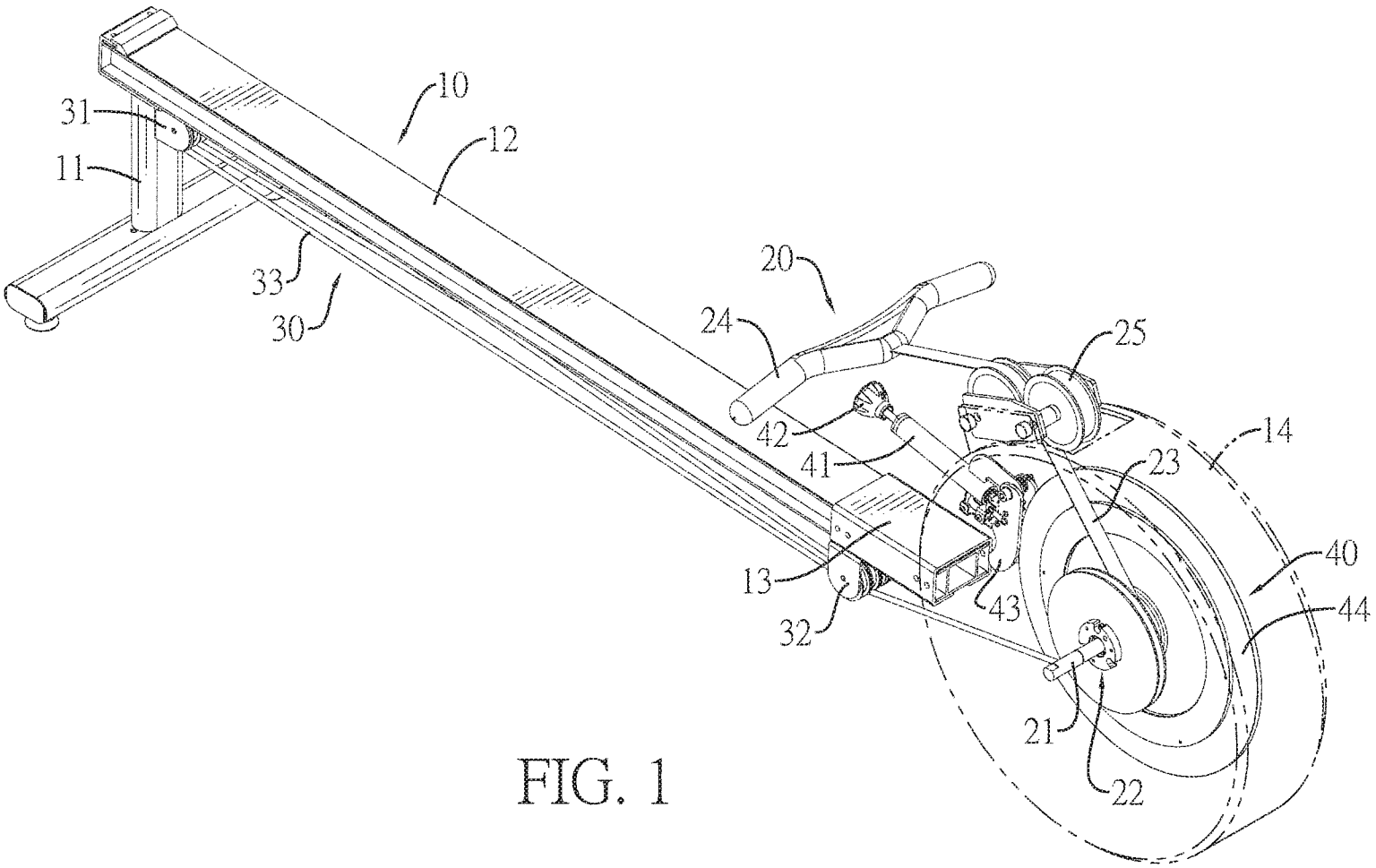
FIG. 1 is a partial perspective view of an indoor rower in accordance with the present invention.
Figure 2:
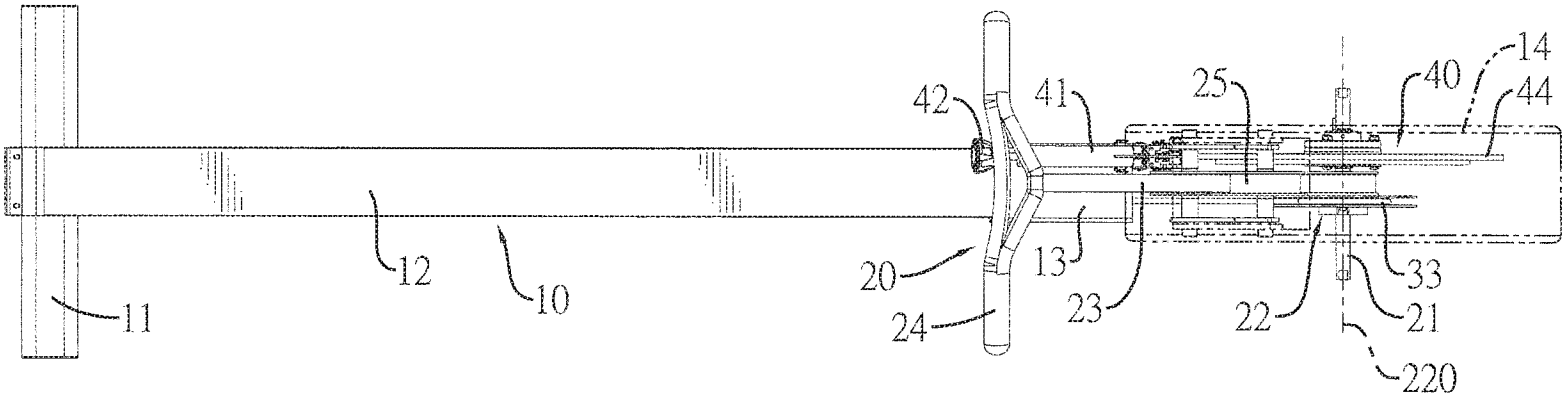
FIG. 2 is a partial top view of the indoor rower in FIG. 1.
Figure 3:
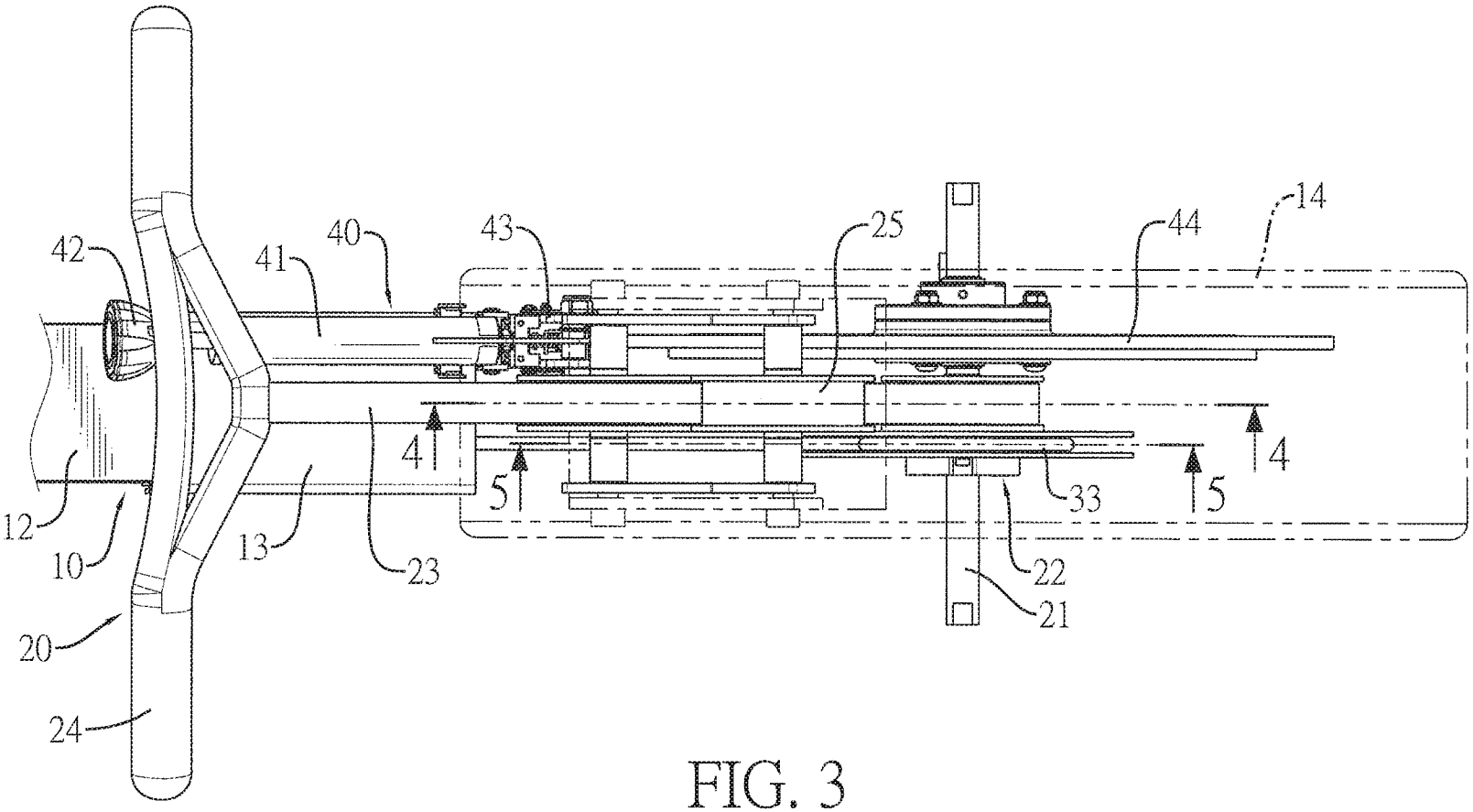
FIG. 3 is a partially enlarged top view of the indoor rower in FIG. 1.
Figure 4:
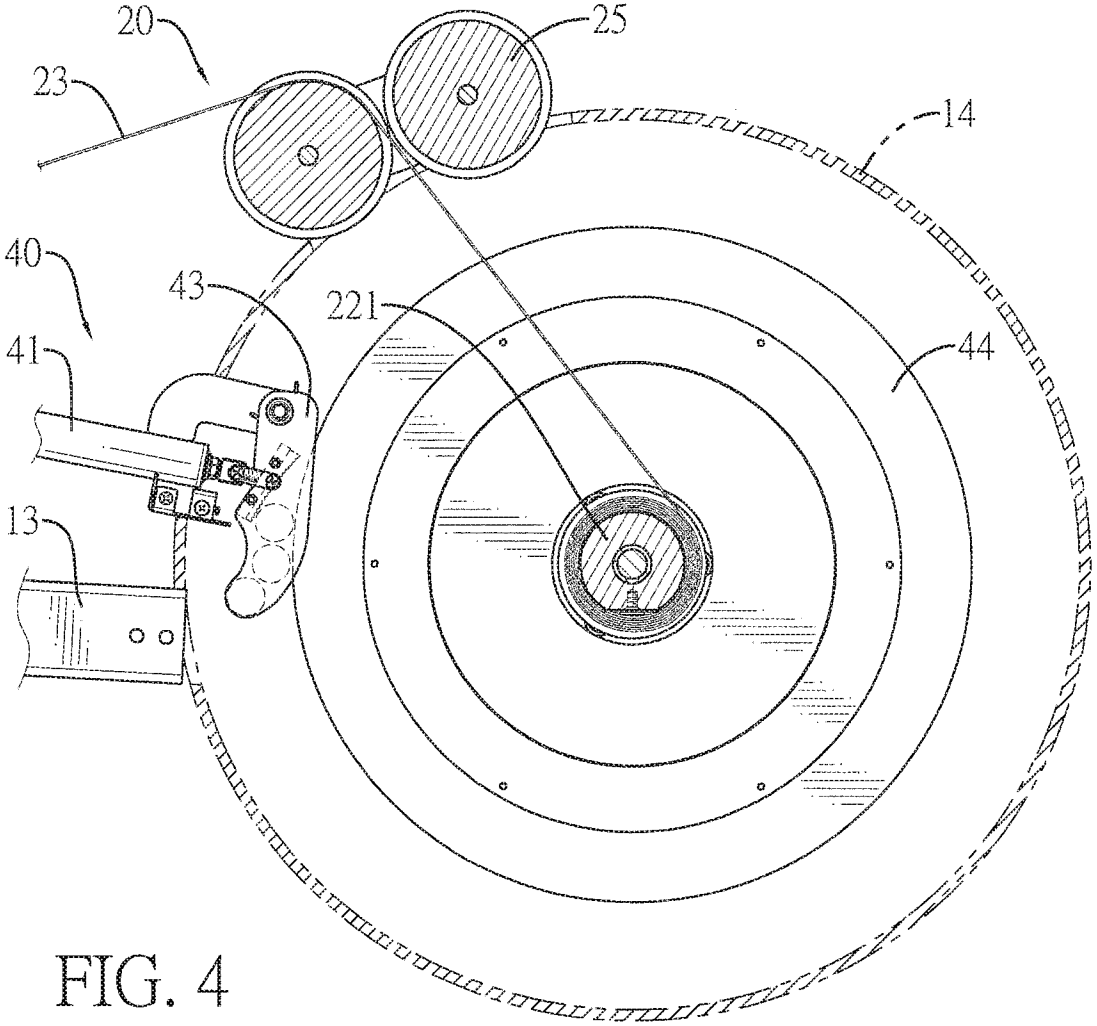
FIG. 4 is a partially cross sectional side view of the indoor rower along the line 4-4 in FIG. 3.

With reference to FIGS. 1, 2, and 3, an indoor rower in accordance with the present invention has a frame 10, a rolling assembly 20, a winding assembly 30, and a resistance assembly 40. The rolling assembly 20 and the winding assembly 30 are mounted to the frame 10. The resistance assembly 40 is mounted to both the frame 10 and the rolling assembly 20.

The frame 10 has a supporting pillar 11, a beam 12, an assembling mount 13, and a cover 14. The supporting pillar 11 has a top end. The beam 12 has a lengthwise direction, a first end, and a second end. The first end and the second end of the beam 12 are opposite each other in the lengthwise direction of the beam 12. The assembling mount 13 is mounted to the beam 12 and is disposed at the second end of the beam 12. The cover 14 is mounted to the beam 12. The cover 14 is disposed adjacent to the second end of the beam 12.

With reference to FIGS. 1 to 4, the rolling assembly 20 is mounted inside the cover 14 of the frame 10 and is disposed adjacent to the second end of the beam 12. The rolling assembly 20 has a shaft 21, a wheel hub 22, a cable 23, a handle 24, and two guiding rollers 25. The shaft 21 is rotatably mounted through the cover 14 and has an elongating direction. The wheel hub 22 is fastened to the shaft 21 and is simultaneously rotatable with the shall 21. The wheel hub 22 has a spinning axis 220, a first coiled section 221, and a second coiled section 222. The spinning axis 220 is disposed along the elongating direction of the shaft 21. The first coiled section 221 and the second coiled section 222 are connected to each other along the spinning axis 220 of the wheel hub 22.

The cable 23 is coiled around the first coiled section 221 of the wheel hub 22 and has a first cable end and a second cable end. The first cable end and the second cable end of the cable 23 are opposite to each other. The first cable end of the cable 23 is fastened to the first coiled section 221 of the wheel hub 22 and is able to spin with the wheel hub 22. The handle 24 is connected to the second cable end of the cable 23. The two guiding rollers 25 are rotatably mounted to the cover 14. Each one of the two guiding rollers 25 has a rolling axis parallel to the spinning axis 220 of the wheel hub 22. The second cable end of the cable 23 passes between the two guiding rollers 25 and then is connected to the handle 24.

The winding assembly 30 has a first pulley set 31, a second pulley set 32, and an elastic cord 33. The first pulley set 31 is connected to the supporting pillar 11. The first pulley set 31 is disposed adjacent to the first end of the beam 12 and below the beam 12. The first pulley set 31 has at least one pulley. The second pulley set 32 is connected to a bottom portion of the assembling mount 13 and is disposed at the second end of the beam 12. The elastic cord 33 has elasticity and may be a flexible rope or even a combination of both a flexible rope and a cotton rope. The elastic cord 33 is coiled around the second coiled section 222 of the wheel hub 22 and has a first cord end and a second cord end. The first cord end and the second cord end of the elastic cord 33 are opposite each other. The first cord end of the elastic cord 33 is stationary. In the embodiment of the present invention, the first cord end of the elastic cord 33 is fastened to the second pulley set 32. The first cord end of the elastic cord 33 may be optionally fastened to elsewhere. The second cord end of the elastic cord 33 is fastened to the second coiled section 222 of the wheel hub 22 and is able to spin with the wheel hub 22.

Figure 6:
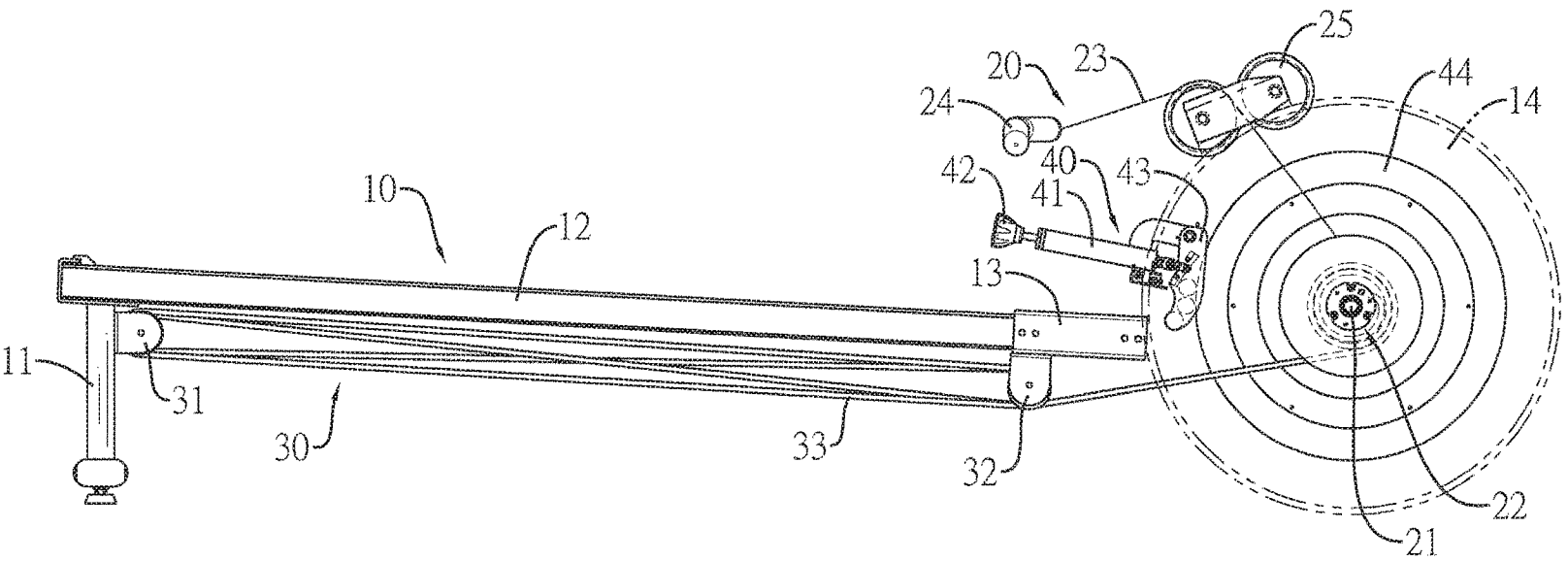
FIG. 6 is a partial side view of the indoor rower in FIG. 1.
Figure 8:
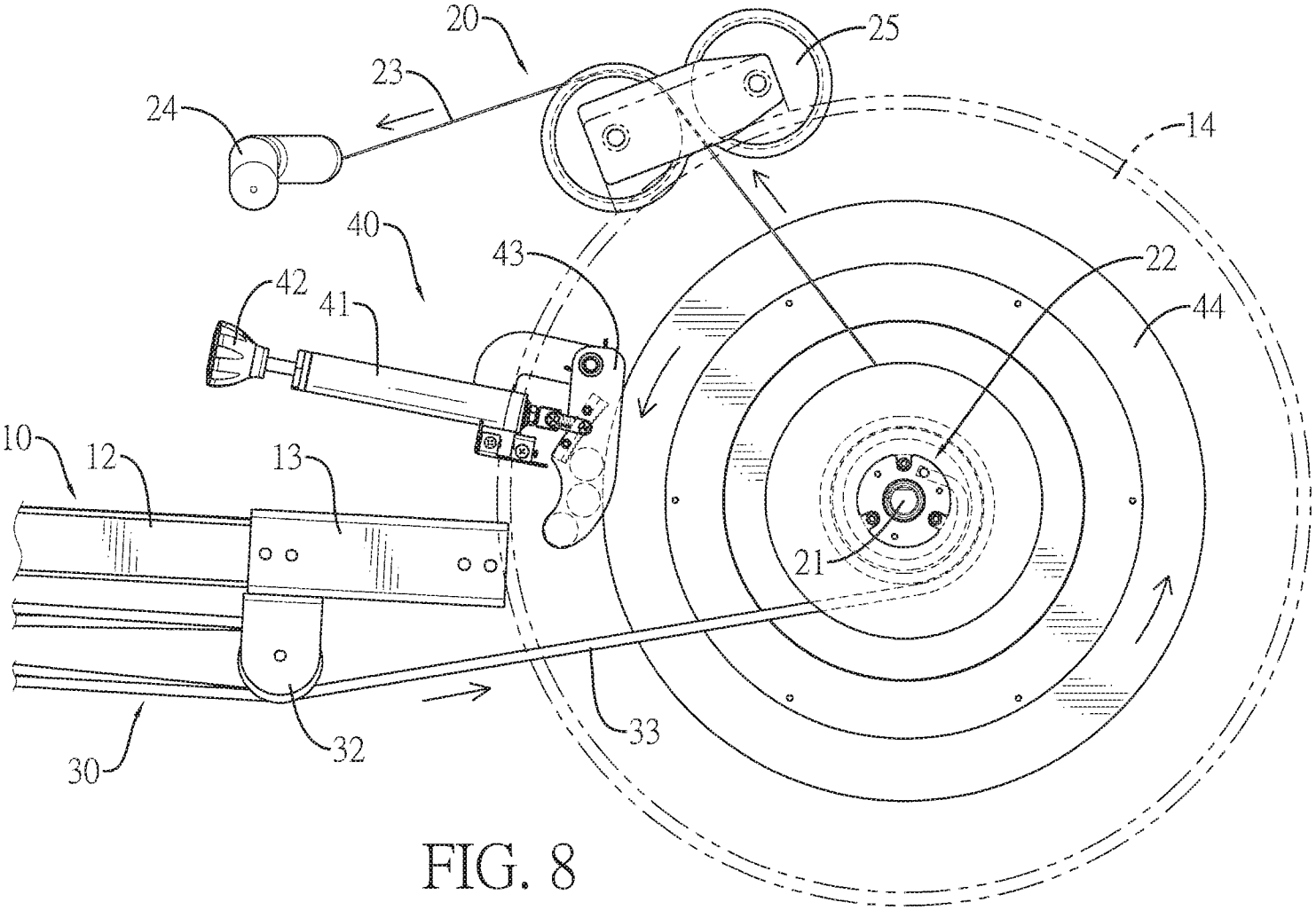
FIG. 8 is a partially enlarged side view of the indoor rower in FIG. 6.
Figure 9:
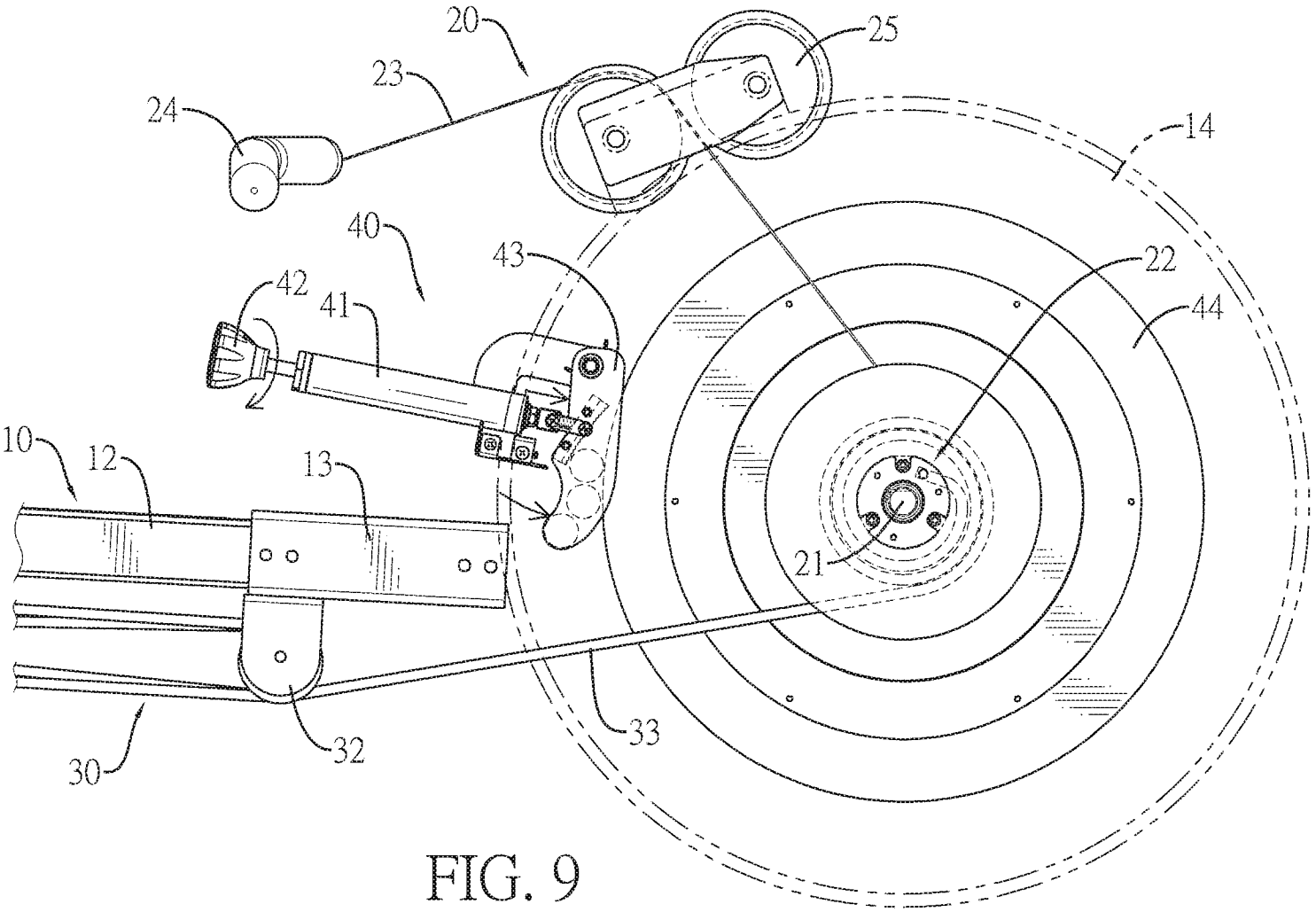
FIG. 9 is another partially enlarged side view of the indoor rower in FIG. 6.

With reference to FIGS. 6 and 8, the resistance assembly 40 is disposed adjacent to the rolling assembly 20 and has a tubular mount 41, an adjusting stick 42, a flywheel 44, and a resistance unit 43. The tubular mount 41 is mounted to the cover 14. The tubular mount 41 is disposed in the lengthwise direction of the beam 12 and extends into the cover 14. The adjusting stick 42 is a threaded rod, is screwed with the tubular mount 41, and is movably mounted through the tubular mount 411. The flywheel 44 may be made of a magnetic material. The flywheel 44 is mounted to the shaft 21, is coaxially connected to the wheel hub 22 via the shaft 21, and is able to simultaneously rotate with the wheel hub 22. The resistance unit 43 is pivotally connected to the tubular mount 41, and is connected to the adjusting stick 42. The resistance unit 43 has multiple magnets and a brake pad. The resistance unit 43 is driven by the adjusting stick 42 and is 2.3 swingable toward the flywheel 44.

Figure 5:
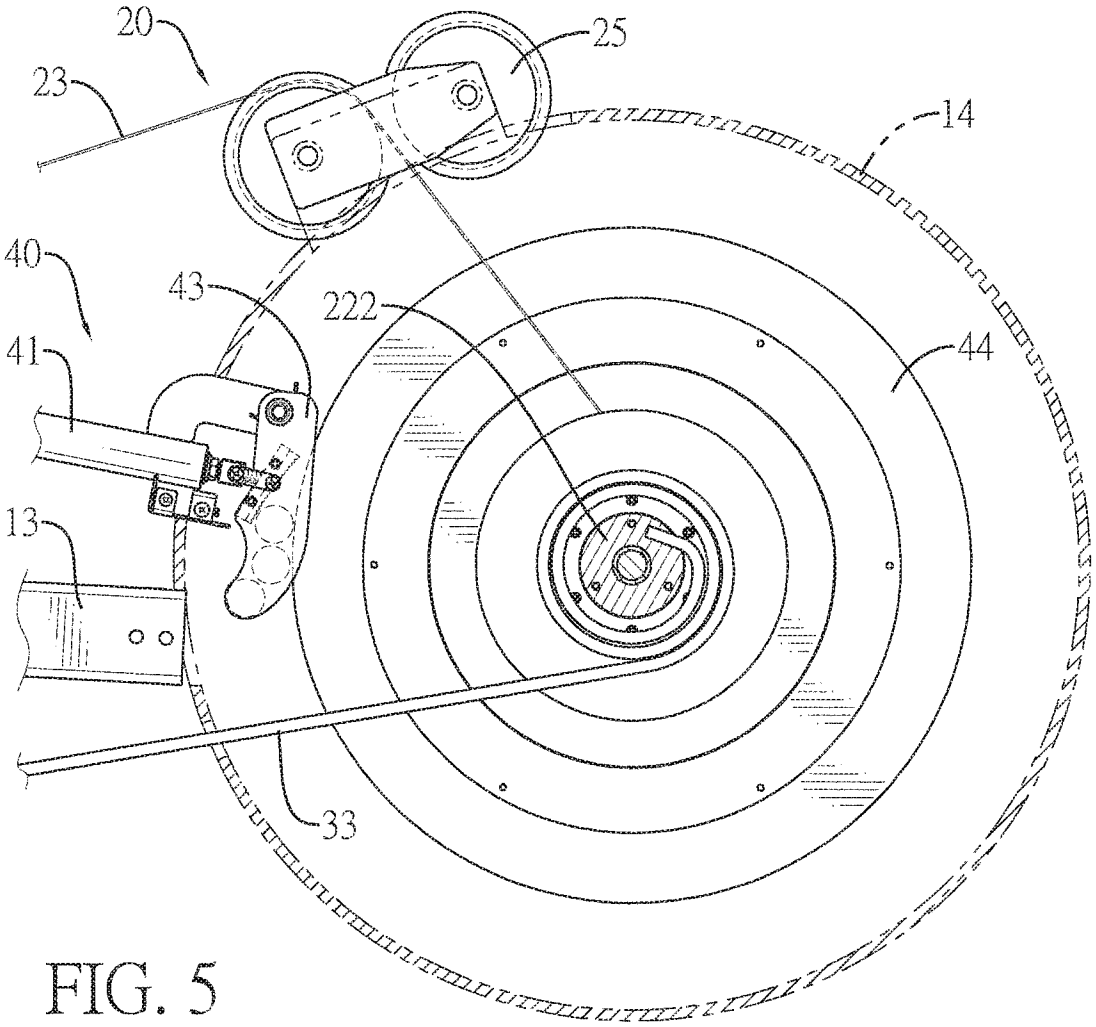
FIG. 5 is a partially cross sectional side view of the indoor rower along the line 5-5 in FIG. 3.
Figure 7:
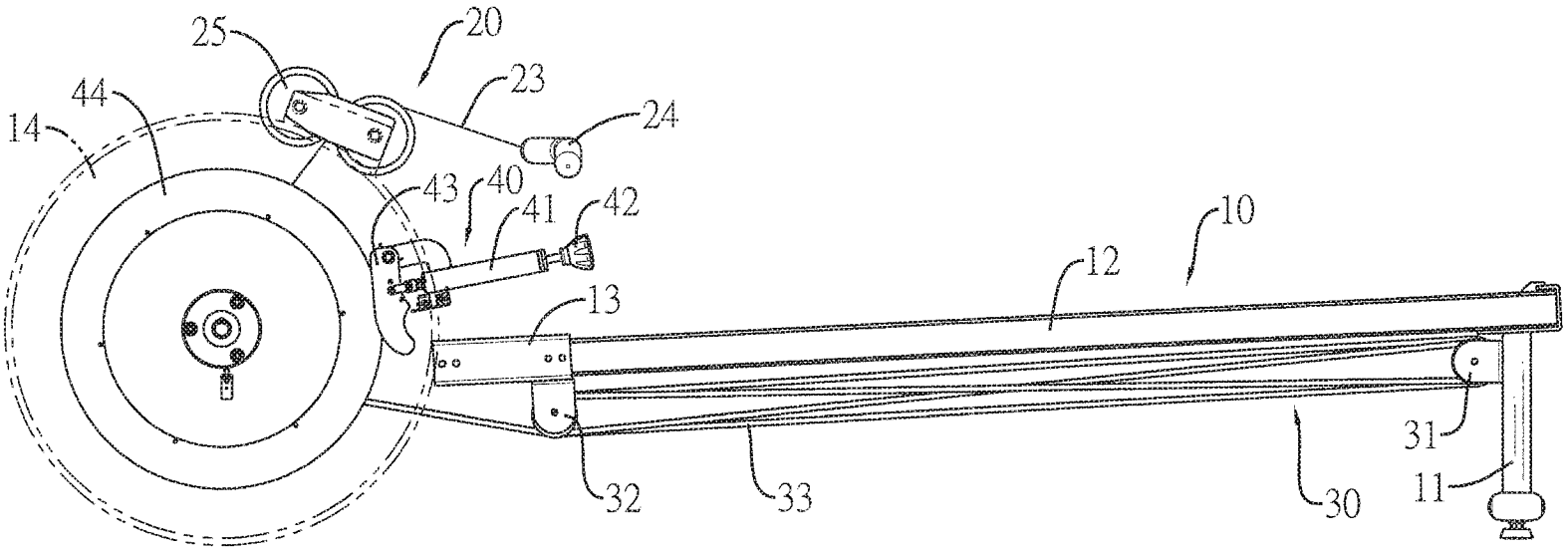
FIG. 7 is another partial side view of the indoor rower in FIG. 1.

With reference to FIGS. 5 and 7, the handle 24 is pulled toward the first end of the beam 12. The cable 23 connected to the handle 24 is pulled out from the cover 14 and is guided by the two guiding rollers 25. Since the cable 23 is coiled around the first coiled section 221 of the wheel hub 22 and the first cable end of the cable 23 is fastened to the first coiled section 221 of the wheel hub 22, the wheel hub 22 rotates along a counter-clockwise direction as shown in FIG. 7. Then the elastic cord 33 is wound up on the second coiled section 222. Once the handle 24 is free from subjecting forces, the elastic cord 33 restores, the elastic cord 33 that is coiled around and fastened to the second coiled section 222 drives the wheel hub 22 to rotate along a clockwise direction as shown in FIG. 7.

The cable 23 is wound up by the wheel hub 22, and the handle 24 connected to the cable 23 is drawn back toward the cover 14. A user reciprocately pulls the handle 24 and is reciprocately drawn by the elastic cord 33 and the cable 23 to simulate the action of watercraft rowing. The restoring force of the elastic cord 33 resists the user to pull the handle 24 and achieves resistance training. The indoor rower in accordance with the present invention utilizes the restoring force of the elastic cord 33 to drive the wheel hub 22 to rotate and make the wheel hub 22 retract the cable 23. The structure of the indoor rower in accordance with the present invention is simple, is convenient for assembling, and has the advantage of low manufacturing cost.

The resistance assembly 40 may be operated to adjust a training load of the indoor rower in accordance with the present invention. The adjusting stick 42 mounted through the tubular mount 41 is able to move toward or away from the flywheel 44. The adjusting stick 42 drives the resistance unit 43 to swing toward or away from the flywheel 44 to adjust a rotational speed of the flywheel 44.

With reference to FIG. 8, the adjusting stick 42 extends into the cover 14 and pushes the resistance unit 43 to swing toward the flywheel 44. The resistance unit 43 equipped with the magnets and the brake pad interferes with the rotating flywheel 44. Since the wheel hub 22 coaxially connected to the flywheel 44 via the shaft 21 is able to simultaneously rotate with the flywheel 44, the wheel hub 22 is difficult to rotate as well. Therefore, the user has to take more effort to pull the handle 24 to connect to the cable 23 that is coiled around the wheel hub 22. A training load of the indoor rower in accordance with the present invention is enhanced.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An indoor rower comprising:
- a frame having a beam having
  - a first end; and
  - a second end opposite the first end of the beam;
- a rolling assembly disposed adjacent to the second end of the beam and having
  - a wheel hub being rotatable;
  - a cable coiled around the wheel hub and having
    - a first cable end fastened to the wheel hub; and
    - a second cable end opposite to the first cable end of the cable;
  - a handle connected to the second cable end of the cable; and
- a winding assembly having
  - a first pulley set disposed adjacent to the first end of the beam and having at least one pulley;
  - a second pulley set disposed at the second end of the beam and having at least one pulley; and
  - an elastic cord with elasticity and coiled around the wheel hub, the at least one pulley of the first pulley set, and the at least one pulley of the second pulley set; and
  - the elastic cord having
    - a first cord end being stationary; and
    - a second cord end opposite the first cord end of the elastic cord and fastened to the wheel hub.

2. The indoor rower as claimed in claim 1, wherein the indoor rower has
- a resistance assembly disposed adjacent to the rolling assembly and having
  - a tubular mount;
  - an adjusting stick movably mounted through the tubular mount;
  - a flywheel coaxially connected to the wheel hub and being simultaneously rotatable with the wheel hub; and
  - a resistance unit connected to the adjusting stick, driven by the adjusting stick, and being swingable toward the flywheel.

3. The indoor rower as claimed in claim 2, wherein the adjusting stick is a threaded rod screwed with the tubular mount.

4. The indoor rower as claimed in claim 3, wherein
- the wheel hub has
  - a first coiled section coiled by the cable; and
  - a second coiled section connected to the first coiled section and coiled by the elastic cord;
- the first cable end of the cable is fastened to the first coiled section; and the second cord end of the elastic cord is fastened to the second coiled section.

5. The indoor rower as claimed in claim 4, wherein
the winding assembly has two guiding rollers; and
the cable passes between the two guiding rollers and is connected to the handle.

6. The indoor rower as claimed in claim 3, wherein
the winding assembly has two guiding rollers; and
the cable passes between the two guiding rollers and is connected to the handle.

7. The indoor rower as claimed claim 2, wherein
the wheel hub has
a first coiled section coiled by the cable; and
a second coiled section connected to the first coiled section and coiled by the elastic cord;
the first cable end of the cable is fastened to the first coiled section; and
the second cord end of the elastic cord is fastened to the second coiled section.

8. The indoor rower as claimed in claim 7, wherein
the winding assembly has two guiding rollers; and
the cable passes between the two guiding rollers and is connected to the handle.

9. The indoor rower as claimed in claim 2, wherein
the winding assembly has two guiding rollers; and
the cable passes between the two guiding rollers and is connected to the handle.

10. The indoor rower as claimed in claim 1, wherein
the wheel hub has
a first coiled section coiled by the cable; and
a second coiled section connected to the first coiled section and coiled by the elastic cord;
the first cable end of the cable is fastened to the first coiled section; and
the second cord end of the elastic cord is fastened to the second coiled section.

11. The indoor rower as claimed in claim 10, wherein
the winding assembly has two guiding rollers; and
the cable passes between the two guiding rollers and is connected to the handle.

12. The indoor rower as claimed in claim 1, wherein
the winding assembly has two guiding rollers; and
the cable passes between the two guiding rollers and is connected to the handle.

* * * * *